US006484466B2

(12) United States Patent
Chun et al.

(10) Patent No.: US 6,484,466 B2
(45) Date of Patent: Nov. 26, 2002

(54) HARDWOOD FLOOR SYSTEM INCLUDING A PIECE OF SPONGE, E-SHAPED PLASTIC RACKS WITH RIBS WHOSE PROJECTIONS ENGAGE THE SHOULDERS AND INCLINED SURFACES OF A PLURALITY OF FLOOR BOARDS

(76) Inventors: Wu Yi Chun, PO Box 82-144, Taipei (TW); Jin-Peau Hsien, PO BOX 82-144, Taipei (TW)

( * ) Notice: Subject to any disclaimer, the term of this patent is extended or adjusted under 35 U.S.C. 154(b) by 27 days.

(21) Appl. No.: 09/824,681

(22) Filed: Apr. 4, 2001

(65) Prior Publication Data

US 2002/0144479 A1 Oct. 10, 2002

(51) Int. Cl.[7] ..... E04F 15/22
(52) U.S. Cl. ..... 52/478; 52/403.1; 52/483.1
(58) Field of Search ..... 52/480, 479, 478, 52/403.1, 483.1, 481.1

(56) References Cited

U.S. PATENT DOCUMENTS 3,553,919 A * 1/1971 Omholt ..... 52/506.1
5,274,977 A * 1/1994 Bayly ..... 52/480
5,497,590 A * 3/1996 Counihan ..... 52/385
5,647,183 A * 7/1997 Counihan ..... 52/403.1

* cited by examiner

*Primary Examiner*—Carl D. Friedman
*Assistant Examiner*—Naoko Slack

(57) ABSTRACT

A hardwood floor structure includes a piece of sponge, a plurality of plastic E-shaped racks with apertures and ribs extending upward, and a plurality of rectangular floor boards composed of an upper portion, an intermediate portion having a protruding flange extending from two adjacent lateral sides and a recess on another two adjacent lateral sides such that the protruding flange is configured and sized to engage with said recess, and a lower portion having an inclined upper edge along a longitudinal side, an inclined lower edge along another longitudinal side, and a shoulder above the inclined lower edge. The ribs on the E-shaped racks have an enlarged head with an inclined surface forming a lower projection to be positioned on the shoulder of a respective one of said floor board. The rib has an upper projection at the other side to be positioned on the inclined upper edge of a respective floor board.

3 Claims, 4 Drawing Sheets

HARDWOOD FLOOR SYSTEM INCLUDING A PIECE OF SPONGE, E-SHAPED PLASTIC RACKS WITH RIBS WHOSE PROJECTIONS ENGAGE THE SHOULDERS AND INCLINED SURFACES OF A PLURALITY OF FLOOR BOARDS

BACKGROUND OF THE INVENTION

1. Field of the Invention

This invention is related to an improvement in the structure of a hardwood floor and in particular to one which can be easily assembled without employing tradespeople to do the work.

2. Description of the Prior Art

The conventional way to construct a hardwood floor is to first lay a piece of waterproof cloth on the ground 3', with a layer of plywood board 2' placed above the cloth and secured to the cloth and the ground by using nails. A plurality of hardwood boards 1' are then assembled and engaged together above the plywood board 2'. This kind of procedure requires technical knowledge and special tools, so that the general consumer cannot complete this by a DIY method. Hence, it has been proposed to put a plastic sheet on the ground directly, and then to mount the hardwood boards on the plastic sheet without using a waterproof cloth or plywood boards. However, this method means that the floorboards are at ground level, and therefore more susceptible to weather and water damage. The floorboards must be closely engaged together, and if the hardwood boards contract or expand in size due to weather or other conditions, the floorboards will raise and become uneven. In addition, if the bottom of the floorboards become wet, they will become mildewed.

Therefore it is an object of the present invention to provide an improvement in the structure of a hardwood floor which can obviate and mitigate the above-mentioned drawbacks.

SUMMARY OF THE INVENTION

This invention is related to an improvement in the structure of a hardwood floor.

It is the primary object of the present invention to provide an improvement in the structure of a hardwood floor which can be easily assembled without employing tradespeople to do the work.

It is another object of the present invention to provide an improvement in the structure of a hardwood floor which can keep air ventilation below the floor.

It is still another object of the present invention to provide an improvement in the structure of a hardwood floor which is composed of a plurality of sections so that the hardwood floor can be adjusted to conform to the ground without influencing its stability.

It is still another object of the present invention to provide an improvement in the structure of a hardwood floor which can effectively reduce noise.

It is still another object of the present invention to provide an improvement in the structure of a hardwood floor which can drain off water on the floor thereby preventing the floor boards from deteriorating.

It is a further object of the present invention to provide an improvement in the structure of a hardwood floor which is good for human ecology.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
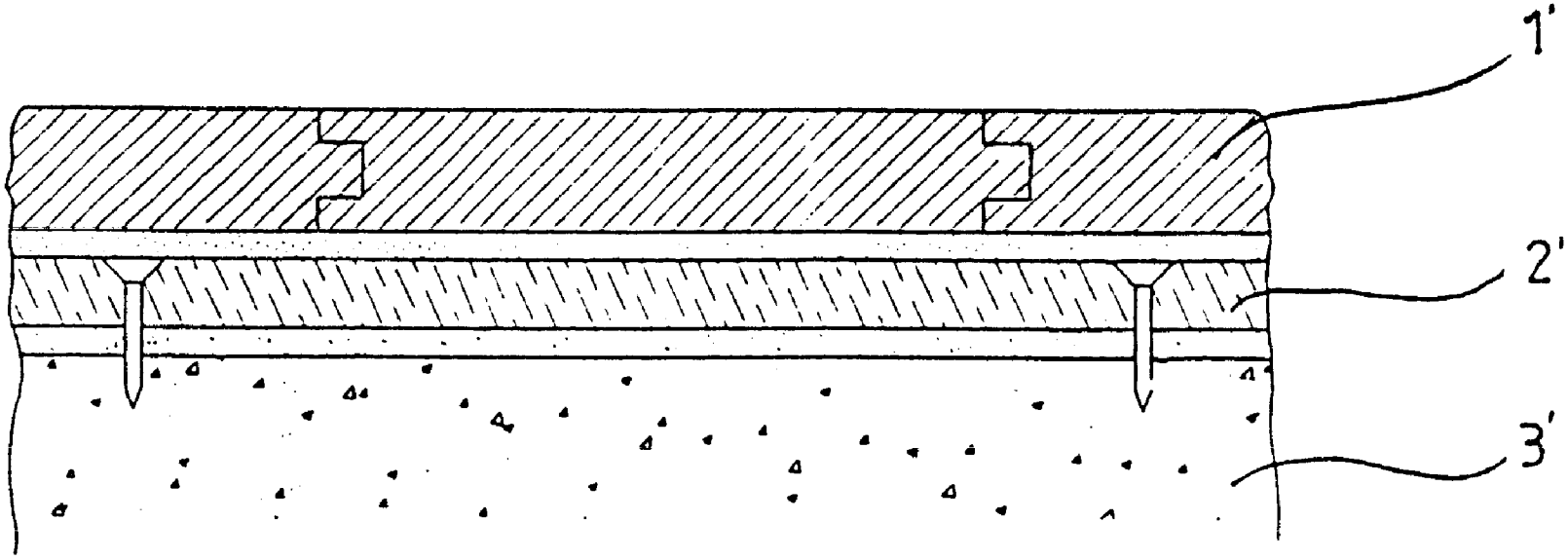
PRIOR ART FIG. 1
FIG. 1 illustrates the structure of a conventional hardwood floor.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
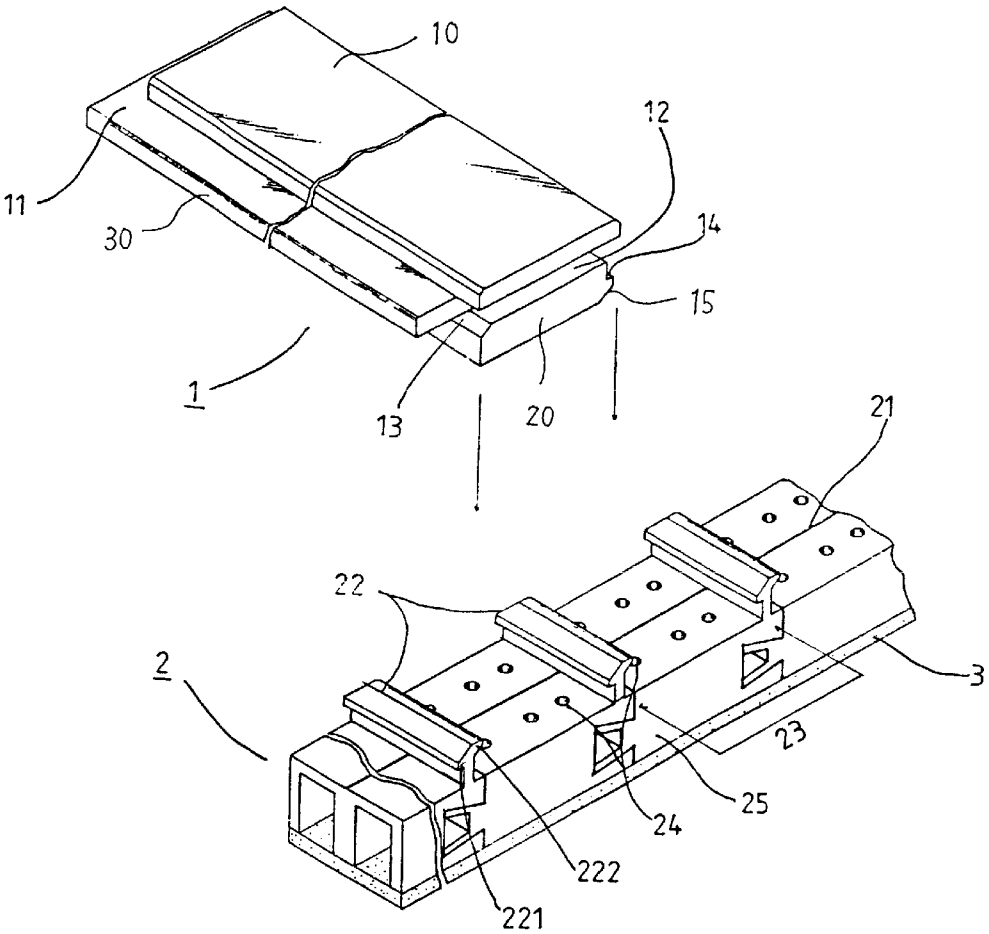
FIG. 2 is an exploded view of the present invention.
Figure 3:
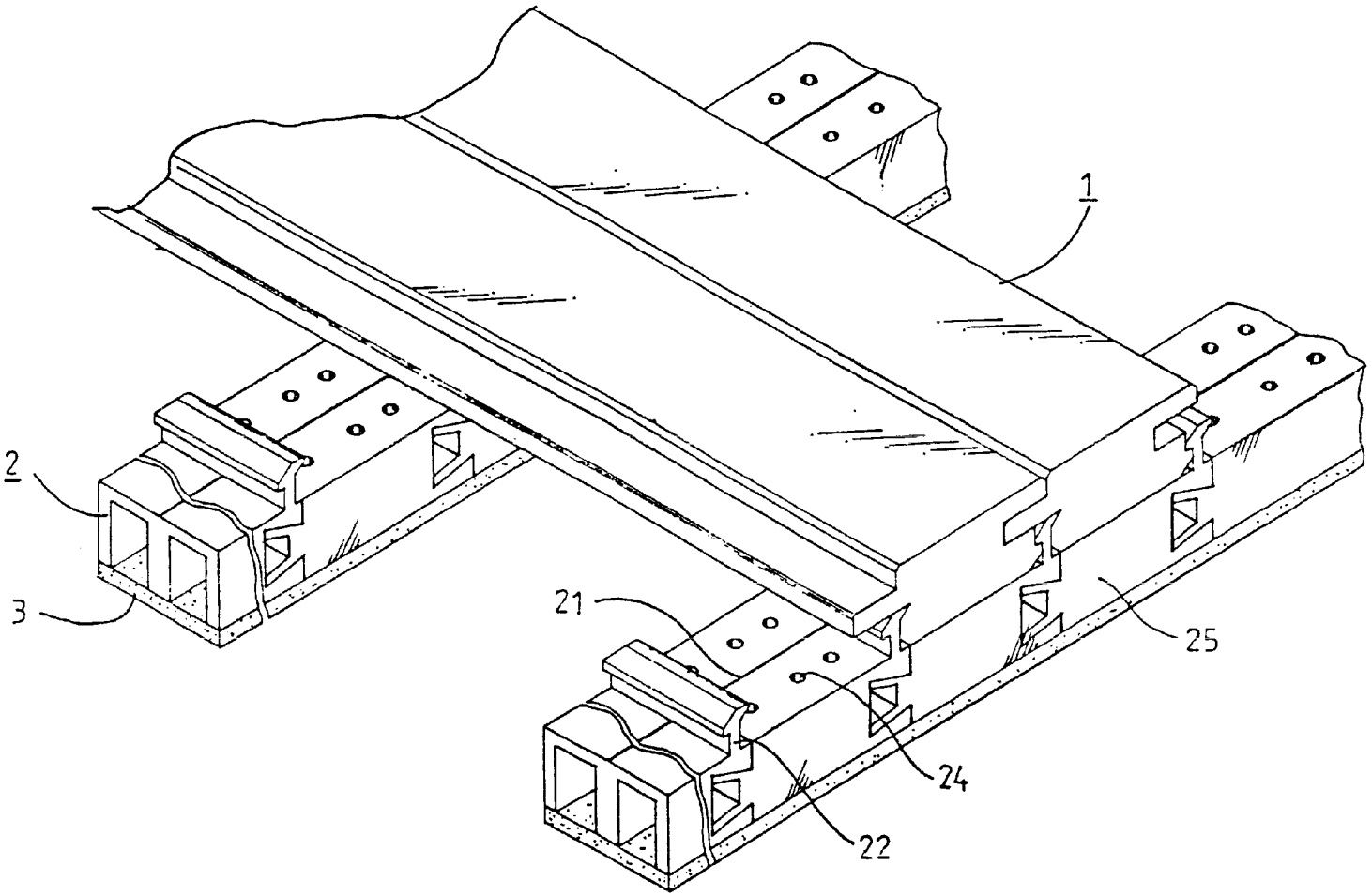
FIG. 3 is a perspective view of the present invention.

With reference to the drawings and in particular to FIGS. 2 and 3 thereof, the hardwood floor according to the present invention generally comprises a plurality of floor boards 1, a plurality of racks 2 and a piece of sponge 3.

The floor board 1 is generally a square or rectangular member composed of an upper portion 10, an intermediate portion 30 and a lower portion 20. The upper portion 10 has a top surface for walling. The intermediate portion 30 includes a protruded flange 11 extending outwardly from two adjacent lateral sides and a recess 12 on the other two lateral adjacent sides. The protruded flange 11 of a floor board 1 is configured and sized to engage with the recess 12 of another floor board 1 so that a plurality of floor boards 1 can be assembled together to form a floor in a flush manner. The lower portion 20 has an inclined upper edge 13 along a longitudinal side thereof, an inclined lower edge 15 along the other longitudinal side thereof, and a shoulder 14 above the inclined lower edge 15. The inclined upper edge 13 is gradually decreased in width.

The rack 2 composed of a plurality of sections 25 which is a plastic member with an E-shaped cross section, which has a plurality of ribs 22 extending upwardly from the top thereof. The rib 22 has an enlarged head with an inclined surface thereby forming a lower projection 221 at one side adapted to be positioned on the shoulder 14 of the floor board 1 and an upper projection 222 at the other adapted to be positioned on the inclined upper edge 13 of the floor board 1. Between every two ribs 22 there is a space 23 configured and dimensioned to receive a floor board 1. The lower projection 221 leans towards the space 23. The top of the rack 2 has a center line 21 for providing position reference and a plurality of through holes 24.

Figure 4:
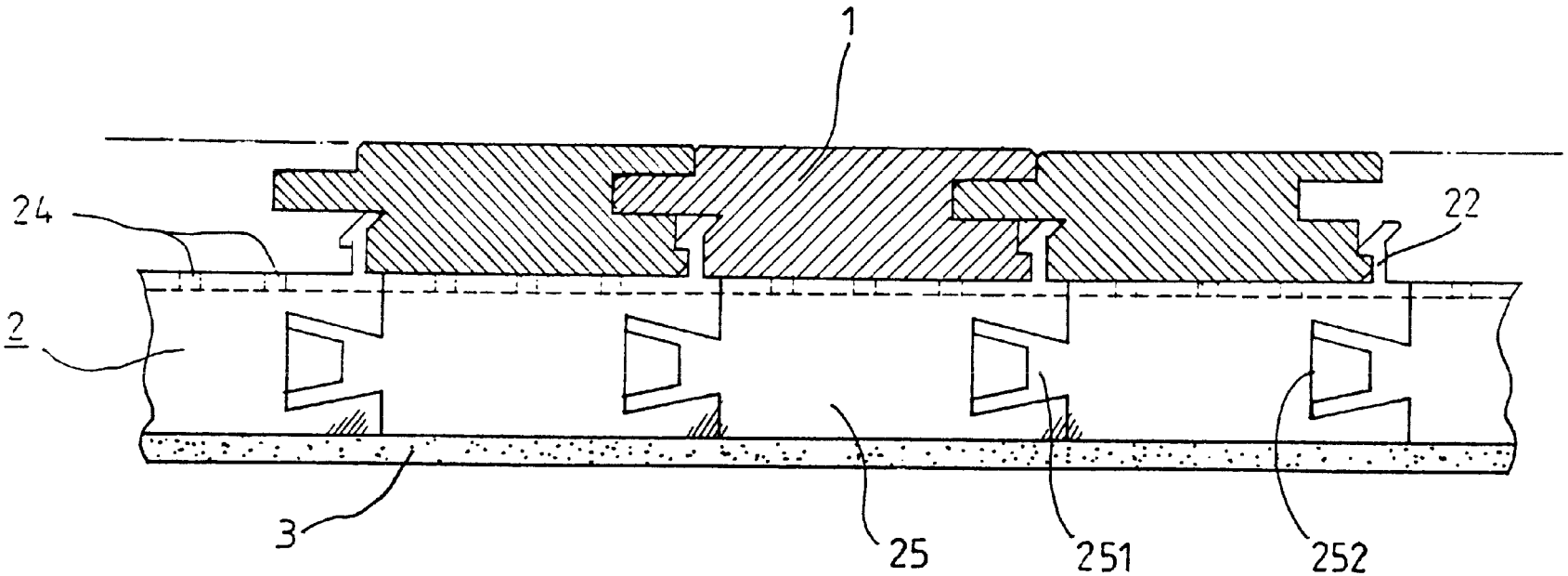
FIG. 4 is a sectional view of the present invention.

As shown in FIGS. 3 and 4, the sponge 3 is first placed on the ground and then the racks 2 are arranged on the sponge 3. Thereafter, the protruded flange 11 of a floor board 1 is engaged with the recess 12 of another and then mounted on the rack 2, with the inclined upper edge 13 and the shoulder 14 of the former fitted under the upper projection 222 and the lower projection 221 of the latter, respectively. When the floor board 1 is pressed into the space 23, the upper projection 222 of the rack 1 will keep the inclined upper edge of the floor board 1 and then the inclined lower edge 15 of the floor board 1 will slide down along the inclined surface of the enlarged head of the rib 22 until the shoulder 14 of the floor board 1 is positioned the lower projection 221 of the rack 2, thereby keeping the floor boards 1 firmly on the racks 2. As the floor boards 1 are not kept in place by the engagement therebetween, it is possible to leave a small clearance between every two adjacent floor boards 1 so that in case of hot weather, the expansion of the floor boards 1 will not cause the floor boards to buckle. In addition, the sponge 3 may reduce the noise produced by the floor boards, and the through holes 24 may drain off the water on the floor boards thereby preventing the floor boards 1 from deteriorating.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. Structure of a hardwood floor comprising:

a piece of sponge;

a plurality of floor boards each being a generally square or rectangular member composed of an upper portion, an intermediate portion and a lower portion, said upper portion having a top surface for walking, said intermediate portion having a protruded flange extending outwardly from two adjacent lateral sides thereof and a recess on another two adjacent lateral sides thereof, said protruded flange being configured and sized to engage with said recess, said lower portion having an inclined upper edge along a longitudinal side thereof, an inclined lower edge along another longitudinal side thereof, and a shoulder above said inclined lower edge;

a plurality of plastic racks with an E-shaped cross section having a plurality of ribs extending upwardly from a top thereof, each of said ribs having an enlarged head with an inclined surface thereby forming a lower projection at one side adapted to be positioned on said shoulder of a respective one of said floor board and an upper projection at another side adapted to be positioned on said inclined upper edge of a respective one of said floor boards, a top of a respective one of said racks having a center line for providing position reference and a plurality of through holes.

2. The structure of a floor board as claimed in claim 1, wherein said inclined upper edge is gradually decreased in width.

3. The structure of a floor board as claimed in claim 1, wherein said lower projection of said ribs leans towards a space between two adjacent ribs.

* * * * *